US008985975B2

(12) United States Patent
Denny

(10) Patent No.: US 8,985,975 B2
(45) Date of Patent: Mar. 24, 2015

(54) MULTISTAGE PUMP SUITABLE FOR USE IN WELLS

(75) Inventor: Mark Joseph Denny, Dorset (GB)

(73) Assignee: BP Exploration Operating Company Limited, Middlesex (GB)

( * ) Notice: Subject to any disclaimer, the term of this patent is extended or adjusted under 35 U.S.C. 154(b) by 658 days.

(21) Appl. No.: 13/138,317

(22) PCT Filed: Jan. 21, 2010

(86) PCT No.: PCT/GB2010/000100
§ 371 (c)(1),
(2), (4) Date: Oct. 11, 2011

(87) PCT Pub. No.: WO2010/092320
PCT Pub. Date: Aug. 19, 2010

(65) Prior Publication Data

US 2012/0018168 A1 Jan. 26, 2012

(30) Foreign Application Priority Data

Feb. 10, 2009 (EP) ..... 09250326

(51) Int. Cl.

| | |
|---|---|
| ***F03C 2/00*** | (2006.01) |
| ***F03C 4/00*** | (2006.01) |
| ***F04C 2/00*** | (2006.01) |
| ***E21B 43/12*** | (2006.01) |
| ***F04C 2/16*** | (2006.01) |
| ***F04C 11/00*** | (2006.01) |
| ***F04C 13/00*** | (2006.01) |

(52) U.S. Cl.
CPC ..... *E21B 43/128* (2013.01); *F04C 2/16* (2013.01); *F04C 11/001* (2013.01); *F04C 13/008* (2013.01); *F04C 2230/60* (2013.01); *F04C 2240/20* (2013.01); *F04C 2240/70* (2013.01)
USPC ..... 418/9; 418/1; 418/102; 418/201.1

(58) Field of Classification Search
CPC .... F04C 23/001; F04C 11/001; F04C 13/008; F04C 2230/60; F04C 2230/70; F04C 2240/30; F04C 2240/70; E21B 43/128
USPC ..... 418/1, 9, 102, 202, 201.1, 48; 166/369
See application file for complete search history.

(56) References Cited

U.S. PATENT DOCUMENTS

| | | | |
|---|---|---|---|
| 750,532 | A | 1/1904 | George |
| 1,423,768 | A | 7/1922 | Holdaway |
| 1,430,894 | A | 10/1922 | Fay |
| 1,751,703 | A | 3/1930 | Long |

(Continued)

FOREIGN PATENT DOCUMENTS

| | | | |
|---|---|---|---|
| CN | 1560 476 | A | 1/2005 |
| CN | 1858972 | A | 11/2006 |

(Continued)

*Primary Examiner* — Theresa Trieu
(74) *Attorney, Agent, or Firm* — Nixon & Vanderhye P.C.

(57) ABSTRACT

Multistage pump comprising a plurality of components which include a plurality of pre-assembled pump modules, having at least one twin screw pump module. The multistage pump further has an elongate sleeve for housing the components, and a securing device attachable or engagable with a portion of the elongate sleeve. The securing device is operable to fixedly retain the components within the sleeve. Each of the pre-assembled pump modules has at least one thrust bearing.

13 Claims, 5 Drawing Sheets

(56) References Cited

U.S. PATENT DOCUMENTS

| | | | | |
|---|---|---|---|---|
| 1,762,708 | A | 6/1930 | Allred | |
| 2,100,560 | A | 11/1937 | Kennedy | |
| 5,779,451 | A | 7/1998 | Hatton | |
| 6,413,065 | B1 | 7/2002 | Dass | |
| 6,457,950 | B1 * | 10/2002 | Cooper et al. | 418/102 |
| 6,592,334 | B1 * | 7/2003 | Butler | 417/53 |
| 2002/0187037 | A1 | 12/2002 | Lee | |
| 2007/0007013 | A1 | 1/2007 | Vandevier et al. | |

FOREIGN PATENT DOCUMENTS

| | | | | |
|---|---|---|---|---|
| CN | 101187367 | A | 5/2008 | |
| CN | 201173176 | Y | 12/2008 | |
| CN | 102155390 | A * | 8/2011 | F04B 47/00 |
| EP | 0 216 406 | A1 | 4/1987 | |
| EP | 0 464 340 | A2 | 1/1992 | |
| GB | 2 152 587 | A | 8/1985 | |
| GB | 2 376 250 | A | 12/2002 | |
| JP | 2-18681 | | 1/1990 | |
| JP | 2-18682 | | 1/1990 | |
| JP | 2-45493 | | 2/1990 | |
| JP | 5-18379 | | 1/1993 | |
| RU | 55 050 | U1 | 7/2006 | |
| WO | WO 95/30090 | A1 | 11/1995 | |
| WO | WO 99/27256 | A1 | 6/1999 | |
| WO | WO 00/37263 | A1 | 6/2000 | |
| WO | WO 03/029610 | A1 | 4/2003 | |

* cited by examiner

MULTISTAGE PUMP SUITABLE FOR USE IN WELLS

This application is the U.S. national phase of International Application No. PCT/GB2010/000100 filed 21 Jan. 2010 which designated the U.S. and claims priority to European Application No. 09250326.7 filed 10 Feb. 2009, the entire contents of each of which are hereby incorporated by reference.

The present invention relates to pumps for lifting fluids, especially multiphase fluids comprising liquid and gaseous phases. The invention relates in particular to pumps such as electric submersible pumps for use downhole in hydrocarbon wells.

BACKGROUND OF THE INVENTION

In the oil and gas industry it is often necessary to deploy and operate a pump downhole in order to assist with hydrocarbon production from a well.

The hydrocarbons from such wells may often be produced in the form of a multiphase fluid, e.g. a fluid comprising one or more liquids such as water and/or crude oil and one or more gases such as natural gas.

Accordingly, it is preferred that a pump that is to be used downhole should be able to: (i) reliably handle multiphase fluids; (ii) generate sufficient pressure to lift fluids from deep hydrocarbon-bearing formations to the surface; and (iii) withstand and operate reliably in harsh downhole environments.

In order to generate sufficient pressure to lift fluids from deep hydrocarbon-bearing formations to the surface, it is known to use multistage pumps, i.e. pumps or pump assemblies containing a plurality of pump stages or modules, in which, typically, a first pump stage discharges into the intake of a second pump stage, which in turn discharges into a third pump stage and so on.

If a single pump stage is capable of generating a given differential pressure, say x psi, at a given flow rate, say y liters/hour, then a pump having two pump stages arranged in series could be constructed, which would be capable of generating a differential pressure of 2x psi at the flow rate of y liters/hour. If the two pump stages were arranged in parallel, then the pump would be capable of generating a differential pressure of x psi at a flow rate of 2y liters/hour.

It is known for oil well electric submersible pumps to use this principle to generate extremely high differential pressures, e.g. 2000-3000 psi (13.8-20.7 MPa). Such pumps may contain 100 or more pump stages arranged in series.

It is known to use multistage centrifugal pumps to lift fluids from deep hydrocarbon-bearing formations to the surface. Centrifugal pumps work by repeatedly accelerating and decelerating the fluid to add incremental pressure increases to the pumped fluid. When being used to pump a mixed-phase fluid containing a liquid and a gas, as a result of the density contrast between liquid and gas the liquid is preferentially accelerated in the first stages of a centrifugal pump. As the proportion of free gas within the fluid increases the gas tends to accumulate in the hub of the pump impellers, thereby causing the pump to lose prime, a condition known as "gas locking". Accordingly, centrifugal pumps may not be entirely suitable for use in pumping mixed-phase fluids.

Other known pump types include plunger type positive displacement pumps and progressing cavity pumps.

Plunger type pumps are similarly affected by free gas entrained in the pumped fluid. In this case, the gas and liquid may separate within the pump barrel, which can cause a shock loading when the plunger descends and contacts the liquid surface, a condition known as "fluid pound".

Progressing cavity pumps typically work by rotating a metal helical rotor within an elastomeric stator, the action of which causes discrete volumetric cavities to progress from the pump intake to the discharge. Although the mode of operation of such a pump makes it suitable for pumping liquids and gas, in practice gas tends to diffuse into the matrix of the elastomeric stator causing it to both swell and soften. As a consequence, the rotor may tend to either tear the stator and/or overheat due to decreased running tolerances and increased friction.

It is known that twin screw positive displacement pumps may reliably be used to produce multiphase fluids. The methods of constructing a twin screw pump and the essential elements of such a pump are well known to the person skilled in the art.

Typically, a twin screw pump may contain a single pair of intermeshing rotors, having oppositely handed screw threads and which rotate, in use, in opposite directions. The thrust generated by the pair of rotors as fluid is pumped through the pump may be borne by a suitable thrust bearing. Alternatively or additionally, a twin screw pump may be thrust balanced, i.e. it comprises two opposing pairs of intermeshing rotors, whereby the thrust generated by one pair of rotors is balanced by the equal and opposite thrust of the opposing rotor pair.

Regardless of the configuration of the pump, the screws of each pair of rotors must be synchronously rotated, typically by gearing the shaft of one rotor to the parallel shaft of the other such that the faces of the intermeshing rotors maintain a close clearance without clashing. Typically, some axial shaft adjustment means may be desirable to simplify the alignment of the start of the rotor threads with respect to each other.

Relatively simple screw mechanisms have been utilised for adjusting shaft alignment in twin screw pumps intended for use on the surface. Such mechanisms, however, are completely unsuitable for downhole or seabed pumps, since these pumps are typically extremely difficult to access for maintenance. Hence, it is much preferred that the rotors and shafts of a twin-screw pump for downhole use are aligned and fixed when the pump is assembled so that no further adjustment will be required during the service life of the pump.

In the past, most twin screw pumps have been produced having only a small number (typically only one) of pump stages; hence, they have often generally been unable to produce the extremely high differential pressures that may be necessary for lifting fluids within hydrocarbon wells.

In more recent times, some multistage twin screw pumps have been developed.

U.S. Pat. No. 5,779,451 discloses a pump which includes a housing having an internal rotor enclosure, the enclosure having an inlet and an outlet and a plurality of rotors operably contained in the enclosure. Each rotor has a shaft and a plurality of outwardly extending threads affixed thereon, the rotors being shaped to provide a non-uniform volumetric delivery rate along the length of each rotor. In one embodiment, the rotors have a plurality of threaded pumping stages separated by unthreaded non-pumping chambers. Although a multistage pump, the housing design precludes it from being used submerged within a well.

U.S. Pat. No. 6,413,065B1 discloses a modular multistage twin screw pump and a method of constructing the same. The stages may be selectively connected either in parallel or series, or any combination of the two, to produce the desired combination of pump pressure and flow rate. The pumps disclosed in U.S. Pat. No. 5,779,451 & U.S. Pat. No. 6,413,065B1 are thrust balanced.

Although suitable for use in a well, each individual module of the pump disclosed in U.S. Pat. No. 6,413,065B1 is extremely complicated containing as it does two shafts, two opposed pairs of intertwined and counter rotating rotors, an intake and discharge plenum and various fluid passages required to enable the individual pump stages to be hydraulically connected together either in series or parallel.

Moreover, a pump according to U.S. Pat. No. 6,413,065B1 would be extremely difficult to construct rapidly and/or in large volumes, not least because of the large number of discrete components which must be accurately aligned as the assembly is built, in particular the pairs of intertwined and counter-rotating rotors which must be axially secured to a common shaft to both control rotor end float (to prevent the screws clashing in operation) and transfer the rotor thrust to the common shaft to balance the opposing rotor thrust. In order to assemble such a pump, the shaft must first be passed through the central support (needle roller) bearing and the opposing rotors keyed, splined or otherwise rotationally secured onto the common shaft to transfer the drive from the shaft to the rotor. The fact that the rotors must be both axially and rotationally fixed to the shafts means that the manufacturing tolerances must be accurately controlled or complex shimming procedures must be used when assembling the pump to ensure the rotors are accurately aligned.

Further, as well as the rotating section, each module contains intake and discharge passages requiring the pump to have numerous different cross sectional profiles, further increasing the complexity of manufacture. In addition, each assembled module is secured with through bolts that necessitate a bulkhead between adjacent modules to provide access to torque them up.

The slow and complex manufacture and assembly of this pump means that it cannot readily be produced in sufficiently large numbers for large-scale commercial projects.

WO 03/029610 discloses another multi-phase twin screw pump for use in wells as well as a method of adapting a multi-phase twin screw pump for use in wells. The pump includes a housing having an intake end and an output end and a fluid flow passage extending between the intake end and the output end. Twin pumping screws are disposed in the fluid flow passage. A supplementary liquid channel extends through the housing in fluid communication with the twin pumping screws and a liquid trap is provided that is in communication with the fluid flow passage. In this way, liquid moving along the fluid flow passage by the pumping screws can be captured and fed through the supplementary liquid channel and returned to the fluid flow passage to enhance a liquid seal around the pumping screws.

However, the pump assembly taught in WO 03/029610 suffers many of the problems discussed above. In particular, assembly of the pump is very time consuming. The components must be assembled sequentially, each being accurately aligned with respect to adjacent components. This not only inhibits large scale production of this pump but makes "on the spot" maintenance of the pump extremely complicated and time consuming should the pump develop an operational problem WO 95/30090 discloses an installation for pumping up liquids from the earth's crust, comprising: a screw pump lowered into the earth which is provided with a first screw member and a counter-screw member, drive means arranged on or close to the earth's surface for driving the screw member which in turn drives the counter-screw member; and transmission means for transmitting the drive produced by the drive means, which transmission means extend from the drive means on or close to the earth's surface to the lowered screw pump.

Further pump assemblies are described in RU 55050U1, WO 99/27256, GB2152587, GB 2376250 and EP 0464340, though none of these address the above-mentioned problems.

Hence, it is a non-exclusive object of the present invention to provide an improved multistage pump, which may in particular be quicker and simpler to assemble and/or more reliable and/or adaptable than known multistage pumps.

SUMMARY OF THE INVENTION

It is a further non-exclusive object of the invention to provide an improved method of assembling a multistage pump, which method may be quicker than known methods and/or may be capable of scaling up for volume manufacture.

According to a first aspect of the invention there is provided a multistage pump comprising:

a plurality of components comprising a plurality of pre-assembled pump modules including at least one twin screw pump module;

characterised in that the multistage pump further comprises an elongate sleeve for housing the components; and securing means attachable or engagable with a portion of the elongate sleeve, the securing means being operable to fixedly retain the components within the sleeve.

By pre-assembled, it is meant that a component, e.g. a pump module, has been made separately as a self-contained unit such that it can be readily and easily incorporated into a more complex system or apparatus, e.g. a modular, multistage pump.

Preferably, one or more of the twin screw pump modules may comprise a pair of intermeshing rotors, wherein one of the rotors is shorter than the other.

Preferably, the or each pre-assembled twin screw pump modules may comprise a housing, a drive shaft and a lay shaft and a thrust bearing, wherein the housing comprises a body having a passage therethrough, the drive shaft and the lay shaft run substantially parallel to each other within the passage and each carry a screw thread or rotor on a portion of their lengths within the passage, the drive shaft being adapted at at least one of its ends for attachment to another component, and wherein the thrust bearing is located at least partially within the housing either above or below the rotors.

In addition to pump modules, the pump may further comprise one or more spacer units. The or each spacer unit may be a discrete component or module. Alternatively, the or each spacer unit may be integral with a pre-assembled pump module.

The plurality of components may further comprise a drive coupling assembly.

Preferably, a spacer unit may be located between a first pump module and a second pump module. Advantageously, the spacer unit may comprise shaft connection means for connecting or coupling a or the drive shaft of the first pump module with a or the drive shaft of the second pump module. For instance, the shaft connection means may comprise a coupling sleeve.

Alternatively or additionally, a or the drive shafts of the pump modules and/or the drive coupling assembly may be adapted such that they may mate directly with one another, e.g. due to the provision of compatible male and female splined connections at the ends of the drive shafts.

The or a drive coupling assembly may comprise means adapted to couple two parallel but offset shafts. Suitable means are well known in the art and may comprise any one of the following: a parallel crank drive coupling; an Oldham coupling; directly meshing gears; double cruciform couplings with an intermediate drive shaft; double constant velocity (CV) joints with an intermediate driveshaft; and double gear couplings with an intermediate driveshaft.

Alternatively, the drive coupling assembly may be adapted to couple a pair of shafts, which are co-axial with one another. In particular, this arrangement may be preferred in larger pumps, i.e. pumps of larger diameter and volumetric capacity such as seabed and pipeline boosting pumps.

Preferably, the components may be arranged in series within the sleeve to form a stack. The stack may comprise a series of components in which a spacer unit is interposed between a pair of pump-modules.

In a preferred embodiment, the uppermost component in the stack may be a or the drive coupling assembly. Alternatively, a or the drive coupling assembly may be the lowermost component in the stack.

The securing means may comprise a means for applying a compressive pre-load, preferably in a lengthwise direction, to the stack.

For example, the securing means may comprise a threaded ring, which is preferably engagable with an end portion of the sleeve. The securing means may comprise a pair of threaded rings, one for engagement with each end of the sleeve.

One or more of the components may be provided with locating or engaging means for maintaining the relative angular alignment of the components within the sleeve. The locating or engaging means may comprise dowel pins or keyways.

The elongate sleeve may have a continuous solid wall. Alternatively, the wall of the elongate sleeve may be discontinuous provided that it has two ends connected together so that the securing means can attach to or engage with a portion of the sleeve to retain the components within the sleeve. For example, the wall of the elongate sleeve may have openings there-through or may take the form of a cage.

According to a second aspect of the invention, a method of assembling a multistage pump comprises:

- providing a plurality of components comprising a plurality of pre-assembled pump modules including at least one twin screw pump module;
- arranging the components into a stack such that the pump modules are located in series;
- inserting the stack within an outer housing or sleeve; and
- operating securing means to fixedly secure the stack within the outer housing or sleeve.

According to a third aspect of the invention, there is provided a pump, preferably a multistage pump, comprising one or more twin screw pump modules, the or each pump module comprising a pair of intermeshing rotors on substantially parallel shafts and a discrete thrust bearing for each rotor.

Preferably, the or each twin screw pump module may be pre-assembled.

The substantially parallel shafts may comprise a drive shaft and a lay shaft, the lay shaft being driven in use by movement, e.g. rotation, of the drive shaft.

By providing a discrete thrust bearing for each rotor, it will be appreciated that there is no need to make the pump in a thrust balanced configuration. Hence, the design of the pump may be simplified, particularly as it may not be necessary to provide numerous and/or complex fluid flow paths through the pump.

Advantageously, the thrust borne by each discrete thrust bearing may be relatively low. Consequently, complex multiple bearing assemblies may not be required, thereby advantageously potentially reducing the complexity and cost of manufacture and assembly of the pump.

A further advantage of providing a discrete thrust bearing for each rotor is that a bearing face may be used as an axial reference point for the rotor during assembly of the pump module. Hence, it may be relatively easy to adjust the axial position of one rotor with respect to its mating counterpart, in order to correctly align a pair of rotors. In practice, this allows the rotor sub-assembly to be assembled and the end float of the driven or lay rotor to be measured with respect to the drive rotor. The mean of the two end float measurements may then provide an ideal shim thickness required below the thrust bearing of the driven shaft.

Alternatively the location of the shafts and their thrust bearings may be fixed, and the relative position of the lay shaft rotor adjusted along the axis of its shaft. For instance, this can be achieved by making the driven or lay shaft rotor shorter than its mating rotor, and varying packing or shims above and below the rotor.

When assembling a pump module, the rotor-bearing shafts may first be trial assembled into position within an open rotor enclosure or jig. The rotors may then be keyed onto their respective shafts and the timing gears then aligned and keyed. The end float of the lay shaft rotor may be measured with respect to the fixed main shaft rotor. The lay shaft may then be axially shimmed onto its shaft. Consequently, when installed into a fully enclosed pump rotor housing the timing gears will already be correctly aligned and may be keyed to the shafts to complete a correctly timed pump module.

Preferably, one of the rotors of each pair may be shorter than the other.

For instance, the driven or lay shaft rotor may be shorter than its mating drive shaft rotor. Advantageously, this may permit the shafts and their thrust bearings to be fixed during assembly of the or each pump module, as the driven or lay shaft rotor may be moved longitudinally along its shaft to bring it into proper alignment with its mating drive rotor. Shims and/or packing may be employed above and/or below the driven or lay shaft rotor to fixedly secure it in the correct position on its shaft.

A further beneficial feature of having an intermeshing rotor pair comprising dissimilar length rotors within a pump module is that the spaces above and below the shorter rotor may naturally form an intake and discharge port (required to prevent the rotors hydraulically locking). Hence, no additional intake or discharge ports may need to be provided in the rotor chamber ends, which may simplify and/or reduce the cost of the pump module.

According to a fourth aspect of the invention there is provided a twin screw pump or pump module for a multistage pump comprising a pair of intermeshing rotors on substantially parallel shafts, wherein one of the rotors is shorter than the other.

In use, a pump according to the present invention may be connected to and driven by a motor. The motor may be a submersible electric motor, preferably a permanent magnet motor.

The motor and pump together (hereinafter known as a motor-pump assembly) may be deployed and operated within a well, e.g. a hydrocarbon production well or an injection well, using jointed tubing, coiled tubing or an electromechanical cable. In use, downhole, the motor may be above or below the pump. Typically, it may be preferred for the motor to be above the pump, when the motor-pump assembly is deployed using coiled tubing or an electromechanical cable.

However, when the motor-pump assembly is deployed using jointed tubing, it may be preferred for the motor to be below the pump.

Hence, it is an advantage of the invention that the motor-pump assembly may be readily built in a bottom drive or a top drive configuration, i.e. where the motor is below or above the pump respectively, to meet the requirements of a specific application, simply by rearranging the components within the outer sleeve or housing.

A multistage pump according to the present invention may, preferably, be operable in forward and reverse directions, e.g. it may be used to produce hydrocarbon-containing fluids from a production well and/or within an injection well to inject a fluid into a hydrocarbon-bearing formation.

A method of producing a fluid, e.g. a fluid comprising at least one liquid phase and at least one gas phase, from or injecting a fluid into a hydrocarbon-bearing formation may comprise deploying and operating a multistage pump according to the present invention within a well.

BRIEF DESCRIPTION OF THE DRAWINGS

In order that the invention may be more fully understood, certain embodiments thereof will now be described by way of example only and with reference to the accompanying drawings in which.

DETAILED DESCRIPTION OF THE INVENTION

Figure 1:
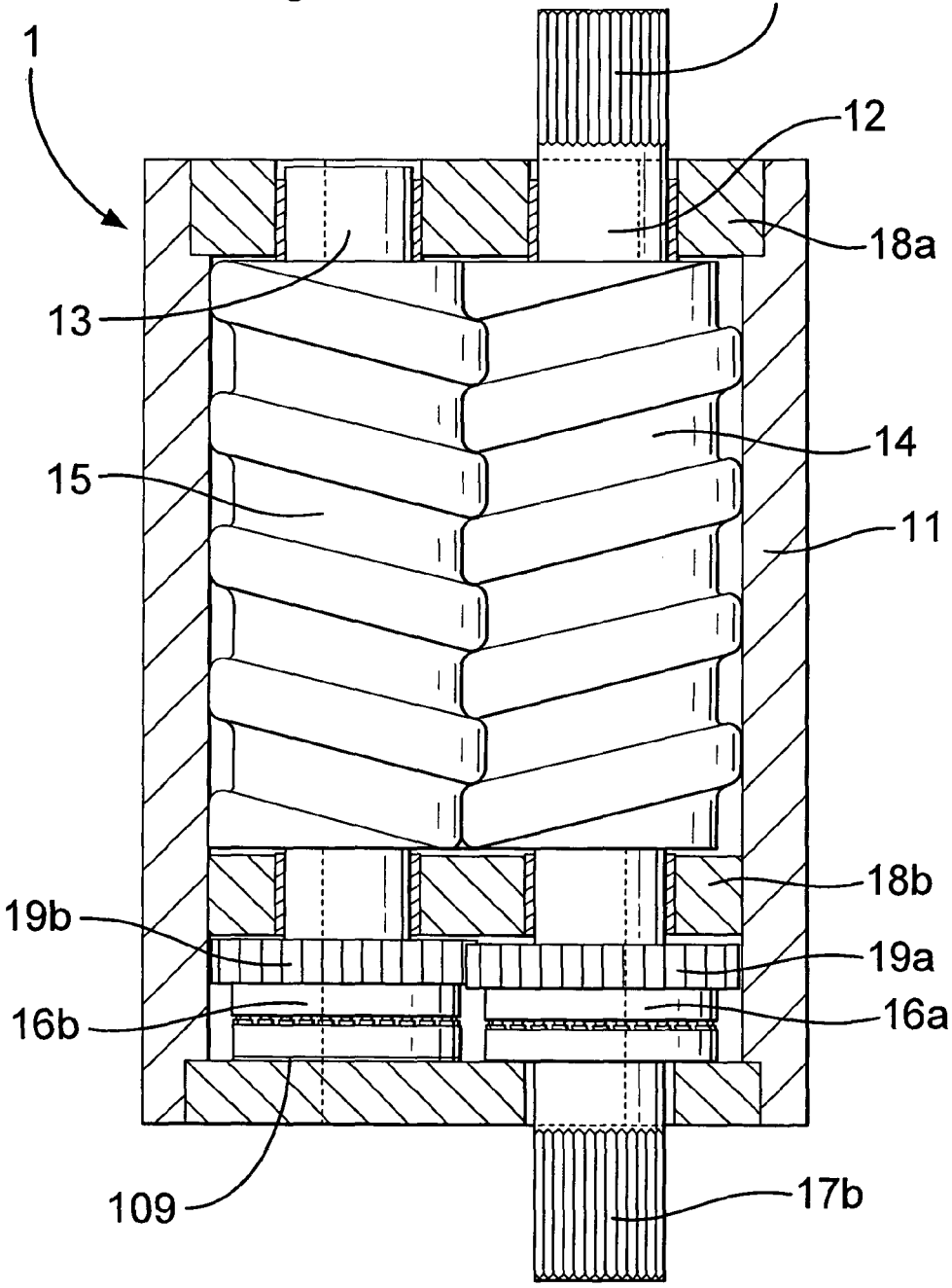
FIG. 1 shows a sectional view of a pump module according to the present invention.

Referring to FIG. 1, there is shown in section a pump module 1 comprising a housing, which comprises a metal cylinder 11 and a top element 18*a* and a bottom element 18*b*, whereby the cylinder 11 and the top and bottom elements 18*a*, 18*b* define a pump chamber. A fluid inlet and a fluid outlet are provided in the top and bottom of the module 1 and provide fluid communication into and out of the pump chamber. The fluid inlet and fluid outlet are hidden from view in the section shown in FIG. 1, but their presence is indicated by dashed lines. Within the pump chamber, extending longitudinally therein, there is a drive shaft 12 and a lay shaft 13. The shafts 12 and 13 are substantially parallel to one another and bearings for each of the shafts 12, 13 are provided in top and bottom elements 18*a*, 18*b*. Threaded rotors 14 and 15 respectively are carried on drive shaft 12 and lay shaft 13 respectively. The rotors 14, 15 have oppositely-handed screw threads. The rotors 14, 15 intermesh and rotate in opposite directions, in use. A thrust bearing 16*a*, 16*b* is provided for each shaft 12, 13 towards the bottom of the housing, below bottom element 18*b*. Located between bottom element 18*b* and the thrust bearings 16*a*, 16*b* are timing gears 19*a*, 19*b*, carried on drive shall 12 and lay shaft 13 respectively. The timing gears 19*a* and 19*b*, while still inter-engaging, are slightly axially offset from each other due to the fact that the lay shaft 13 is shimmed with respect to the drive shaft 12 by shims 109 located below the thrust bearing. Upper and lower end portions 17*a*, 17*b* of the drive shaft 12 extend upwardly and downwardly beyond the ends of the housing. The end portions 17*a*, 17*b* have splines. These splines are designed to aid the coupling of the shafts 22, 23 to shafts on other components using a coupling sleeve with complementarily shaped internal splines.

Figure 2:
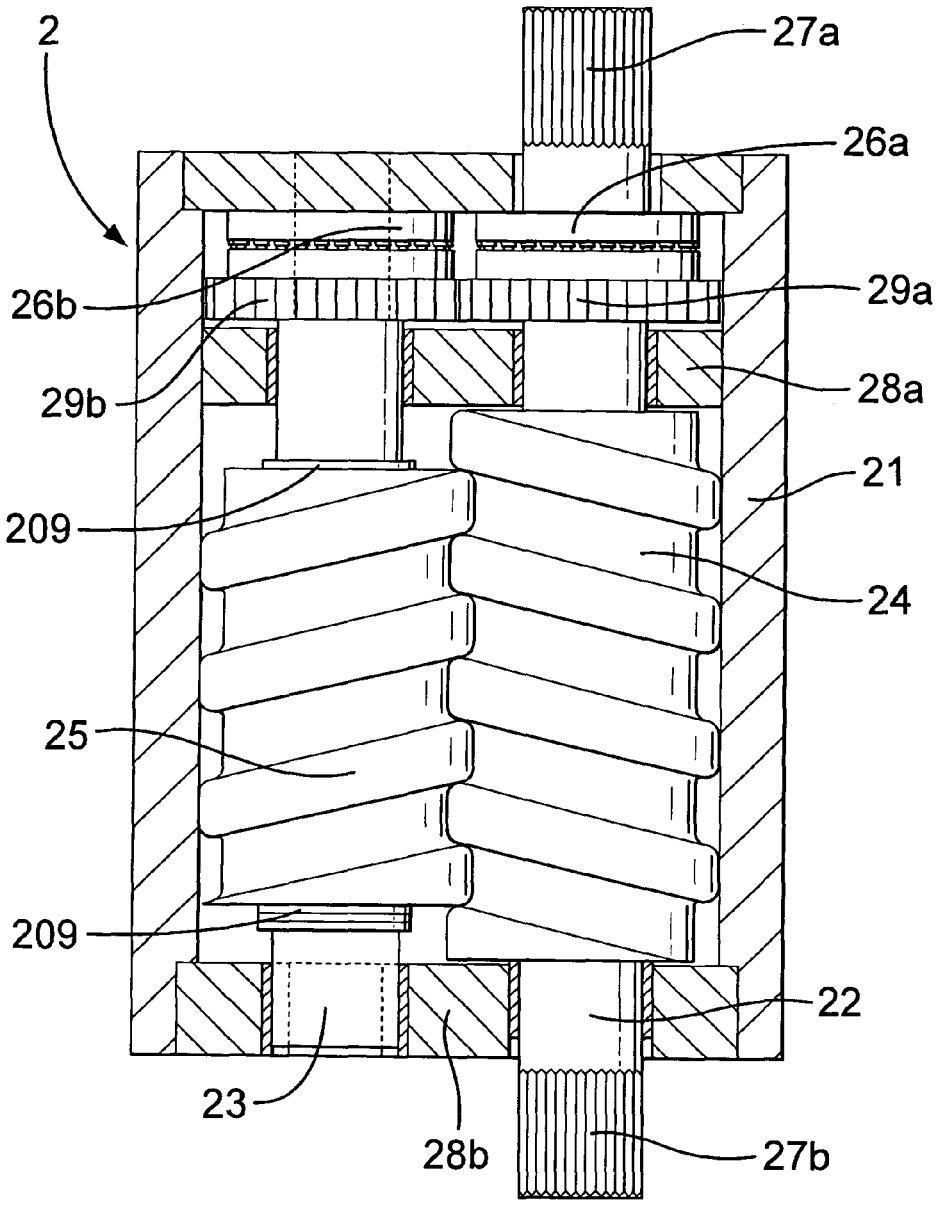
FIG. 2 shows a sectional view of a second pump module according to the present invention.

In FIG. 2 there is shown in section a pump module 2, which is broadly similar to the pump module 1 shown in FIG. 1.

Referring to FIG. 2, there is shown in section a pump module 2 comprising a housing, which comprises a metal cylinder 21 and a top element 28*a* and a bottom element 28*b*, whereby the cylinder 21 and the top and bottom elements 28*a*, 28*b* define a pump chamber. A fluid inlet (not shown) and a fluid outlet (not shown) are provided in the top and bottom of the module 1 and provide fluid communication into and out of the pump chamber. The fluid inlet and fluid outlet are hidden from view in the section shown in FIG. 2, but there presence is indicated by dashed lines. Within the pump chamber, extending longitudinally therein, there is a drive shaft 22 and a lay shaft 23. The shafts 22 and 23 are substantially parallel to one another and bearings for each of the shafts are provided in top and bottom elements 28*a*, 28*b*. Threaded rotors 24 and 25 respectively are carried on drive shaft 22 and lay shaft 23 respectively. The rotors 24, 25 have oppositely-handed screw threads. The rotors 24, 25 intermesh and rotate in opposite directions, in use. Threaded rotor 25 is shorter than threaded rotor 24. Lay shaft 23 also carries shims 209 for axially aligning threaded rotor 25 with threaded rotor 24. In contrast to the pump module shown in FIG. 1, the lay shaft 23 and drive shaft 22 are not shimmed with respect to one another; rather, the shims 209, one above and three below the rotor 25 serve to align the rotor 25 with respect to the shaft 23 on which it is mounted.

A thrust bearing 26*a*, 26*b* is provided for each shaft 22, 23 towards the top of the housing, above top element 28*a*. Located between top element 28*a* and the thrust bearings 26*a*, 26*b* are timing gears 29*a*, 29*b*, carried on drive shaft 22 and lay shaft 23 respectively. The timing gears 29*a* and 29*b* are inter-engaging and are not axially offset from each other, due to the fact that, as explained above, the shafts 22, 23 are not shimmed with respect to one another. Upper and lower end portions 27*a*, 27*b* of the drive shaft 22 extend upwardly and downwardly beyond the ends of the housing. The end portions 27*a*, 27*b* have splines. These splines are designed to aid the coupling of the shafts 22, 23 to shafts on other components using a coupling sleeve with complementarily shaped internal splines.

In either of the pump modules shown in FIGS. 1 and 2, it should be appreciated that the relative positions of the timing gears and thrust bearings may equally well be reversed, i.e. the thrust bearing may be nearer the rotors than the timing gears.

Figure 3:
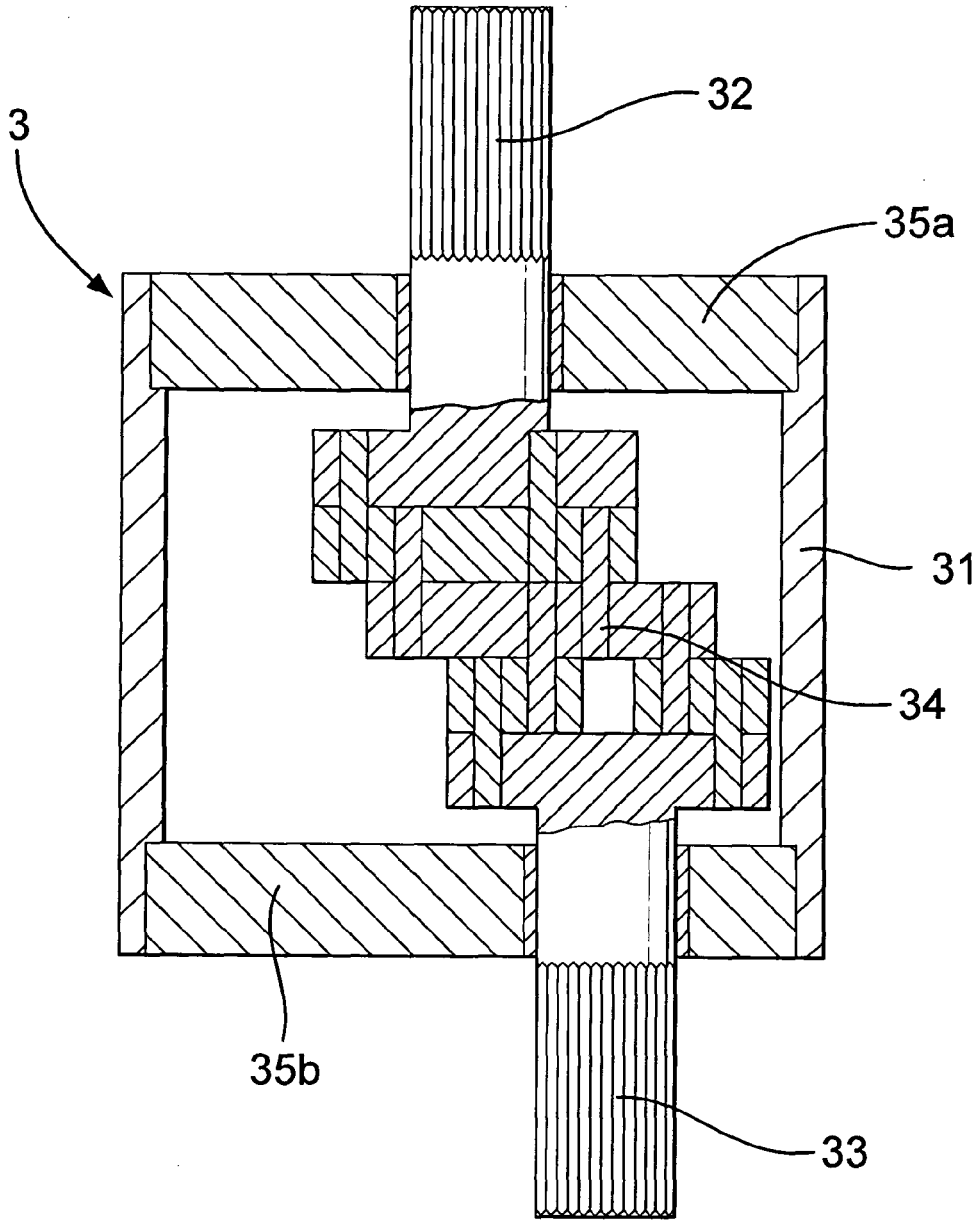
FIG. 3 shows an example of a drive shaft assembly for use in a multistage pump according to the present invention.

In FIG. 3 there is shown in section a drive shaft assembly 3 for use in a multistage pump according to the present invention. The drive shaft assembly 3 comprises a chamber defined by a cylindrical body 31, a top element 35*a* and a bottom element 35*b*. The top element 35*a* and bottom element 35*b* comprise bearings for shafts passing therethrough. Extending upwardly from the chamber and passing through the bearing in top element 35*a* is a first shaft 32. The longitudinal axis of shaft 32 is coincident with the longitudinal axis of the cylindrical body 31. Extending downwardly from the chamber and passing through the bearing in bottom element 35*b* is a second shaft 33. The longitudinal axis of the second shaft 33 is parallel with that of the first shaft 32, but is not coincident with the longitudinal axis of the cylindrical body 31, i.e. the shafts 32, 33 are radially offset from one another. Within the chamber there is a mechanism 34 for coupling the first shaft 32 with the second shaft 33. The mechanism 34 comprises a parallel crank drive coupling. Other suitable mechanisms will be well known to the person skilled in the art.

End portions of first shaft 32 and second shaft 33 protruding from the top and bottom of the cylindrical body 31 are provided with splines. These splines are designed to aid the coupling of the shafts 32, 33 to shafts on other components using a coupling sleeve with complementarily shaped internal splines.

In use, the first shaft 32 will typically be coupled to the output shaft of a motor, e.g. a submersible electric motor.

In use, the second shaft 33 will typically be coupled to the drive shaft of a pump module such as either of the pump modules shown in FIG. 1 or FIG. 2.

Figure 4A:
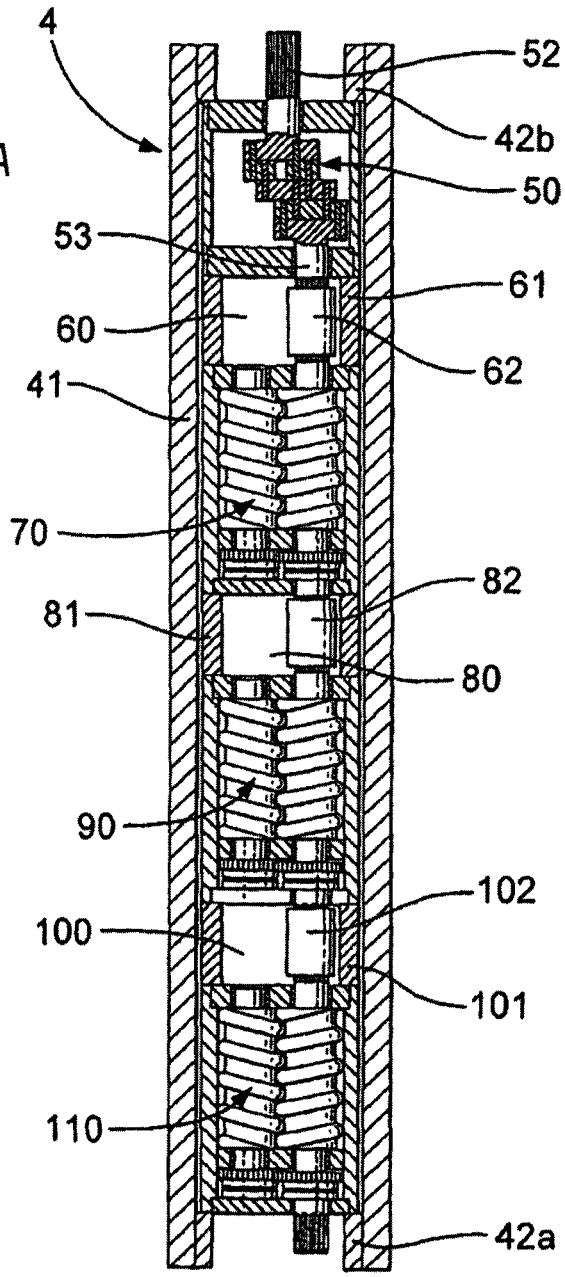
FIGS. 4A and 4B show an assembled multistage pump according to the present invention.
Figure 4B:
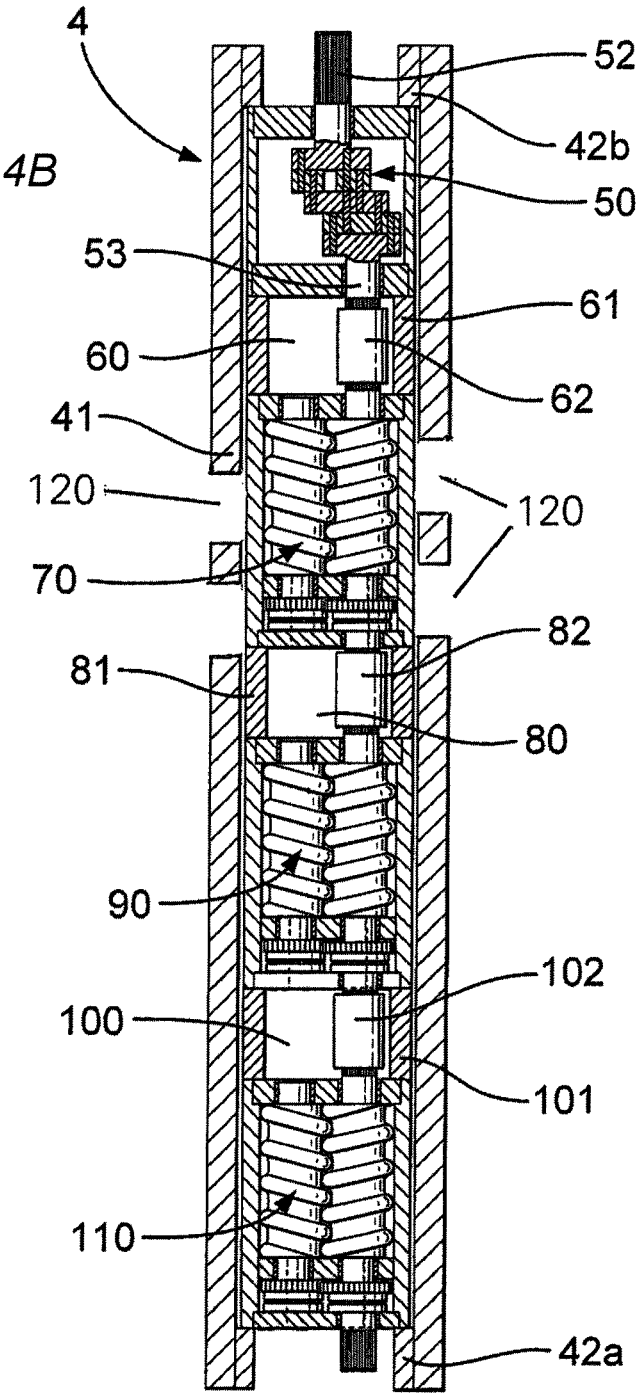

In FIGS. 4A and 4B, there is shown an assembled multistage pump 4. The pump 4 comprises an outer sleeve 41 which has a continuous solid wall in the form of a cylinder, within which is arranged a series of components which constitute the pump. In FIG. 4B, the wall elongate sleeve is discontinuous at 120. From the top (as seen in FIG. 4A), the components consist of a drive shaft assembly 50, a first spacer cylinder 60, a first pump module 70, a second spacer cylinder 80, a second pump module 90, a third spacer cylinder 100 and a third pump module 110.

The drive assembly 50 is substantially as shown in FIG. 3 and described above.

The pump modules 70, 90, 110 are substantially as shown in FIG. 1 and described above. Of course, one or more pump modules substantially as shown in FIG. 2 and described above could be incorporated within the multistage pump 4.

The spacer cylinders 60, 80 and 100 each comprise a cylindrical body 61, 81 and 101 and a coupling sleeve 62, 82, 102. Each of the coupling sleeves 62, 82, 102 has an inner surface which matches the undulating surfaces of the end portions of the shafts extending from the pump modules and/or the drive shaft assembly. Accordingly, in use, each coupling sleeve effects a sliding joint between the end portions of two shafts and prevents axial rotation of one shaft relative to the other. Advantageously, this means that the timing of the two shafts within a pump module is not referenced to, or affected by, the timing of the shafts in any other pump module. Further, it will be appreciated that sliding joints, being relatively simple, may greatly assist the rate of construction of a stack of components for inclusion within a sleeve or outer housing.

In the embodiment shown in FIG. 4A, first spacer cylinder 60 is disposed between drive shaft assembly 50 and first pump module 70; second spacer cylinder 80 is disposed between first pump module 70 and second pump module 90; and third spacer cylinder 100 is disposed between second pump module 90 and third pump module 110.

A preferred method of assembling the multistage pump 4 shown in FIG. 4A will now be described.

The cylindrical body 101 of spacer cylinder 100 is placed on top of pump module 110 and coupling sleeve 102 is placed around the upper end of the drive shaft of pump assembly 110. Pump module 90 is then placed on top of spacer cylinder 100, the lower end of the drive shaft of pump module 90 being inserted into coupling sleeve 102 and thereby being coupled with the drive shaft of pump module 110. In like manner, spacer cylinder 80, pump module 70, spacer cylinder 60 and drive shaft assembly 50 are added in turn form a stack. It will be appreciated that there will be at least one path for pumped fluid to pass through each of the components in turn from the bottom to the top of the stack or vice versa. It will further be appreciated that the upper and lower faces of each component (spacer cylinder, pump module and drive shaft assembly) will mate to form a seal against pressure and flow from the interior to the exterior of the stack. This can be achieved by providing metal to metal or o-ring seals on the abutting surfaces.

The stack comprising components 50, 60, 70, 80, 90, 100 and 110 is then slid inside sleeve 41. Lower and upper threaded rings 42*a*, 42*b* are put in place inside the lower end and upper end of sleeve 41 respectively. The threaded rings 42*a*, 42*b* are tightened, thereby imparting a compressive load to the stack to help hold it in place within the sleeve 41 and form a seal between each module. The multistage pump 4 is now ready for use.

The deployment and use of multistage pump 4 will now be described.

Once the multistage pump 4 has been deployed, it is attached at its top end to a motor. The upwardly extending shaft 52 which extends from the drive shaft assembly 50 at the top of the stack is coupled to an output shaft of the motor using a coupling sleeve.

The motor-pump assembly (i.e. the motor and pump together) is then attached at its top end to a coiled tubing or electromechanical cable, which tubing or cable is capable of supporting the weight of the motor-pump assembly and supplying electrical power thereto.

The motor-pump assembly is then lowered into a well by unwinding the tubing or cable from a reel or drum as is known in the art. The motor-pump assembly is generally lowered to below the level of fluid within the well. Electrical power is supplied to the motor to drive the pump, which may then lift fluid from the well.

In preferred embodiments, dowel shafts or keyways may be provided on the ends of the components within the stack, e.g. pump modules, spacer cylinders and drive shaft assemblies to ensure and maintain the angular alignment of the components within the stack and that the various driven shafts remain aligned in use.

As has been noted previously, the twin screw pump modules contained within the multistage pumps of the present invention may be pre-assembled. Moreover, it will be appreciated that the relatively simple design of the pump modules of the present invention may be manufactured from a small number of basis parts, thereby allowing relatively fast manufacture of relatively large numbers of pump modules.

Advantageously, since the pre-assembled pump modules may be accurately timed, it may be relatively quick and simple to produce a multistage pump by arranging the components into a stack, which may be inserted into an outer housing or sleeve.

It should be appreciated that the invention allows for any number of pre-assembled components to be rapidly combined into a complete pump, provided that the outer housing is selected such that it is sufficiently long to house them.

Since hydrocarbon fluids may exhibit a continuous range of liquid to gas ratio, depending not only on the composition of the fluid by molecular weight but also the temperature and pressure to which it is subjected, the present invention advantageously allows the construction of pumps which may be individually optimized to the fluid to be pumped.

For instance, if the pump is to be used substantially for gas compression it is a simple matter to construct the pump such that it includes pump modules with different rotor assemblies to accommodate the smaller volume occupied by the gas as it is compressed from stage to stage.

A multistage pump having one, two or more different pump stages within a single housing is known as a tapered pump. Advantageously, the invention makes it possible to easily construct a tapered twin screw pump from relatively few component parts.

A number of other advantages of the present invention will be evident to the skilled reader. For instance, the provision of a thrust bearing and timing gear within each pump module provides redundancy for the completed pump.

The benefit of such redundancy may be illustrated by an example. Consider a pump with eight rotor pairs (i.e. eight pump modules): if the thrust bearing or timing gears of one rotor pair fails, then the remaining seven sub-assemblies may be un-affected. Advantageously, since each thrust bearing only carries the load from one rotor, it may be relatively lightly loaded and hence relatively unlikely to fail. Similarly, the timing gears may be lightly loaded and less likely to fail.

In a pump according to the present invention, if one rotor section fails, then the rotors will grind against each other and operate with high rolling friction. However the pump may still turn and the main shaft (i.e. the series of drive shafts) may not be overloaded.

In contrast, if, as in the prior art, the rotors are provided on a common shaft supported on a single timing gear and thrust bearing assembly, any failure of the rotor timing (due to gear or thrust bearing failure or wear) will cause all the rotors so timed to make contact simultaneously, with proportionally increased rolling friction, which may cause the pump to fail.

Therefore, a pump according to the present invention may be more reliable in use due to the redundancy of the critical (rotor timing) components. Accordingly, the pump may not need to be fixed or replaced as frequently as known pumps.

Moreover, another advantageous feature of the present invention is that it provides the possibility of repairing a damaged pump, since the entire assembly can be rapidly disassembled and individual rotor sub-assemblies (pump modules) checked for correct rotor alignment, end float and shaft bearing wear. If one or more pump modules are faulty, then it or they can be rapidly replaced using other pre-assembled pump modules held in stock, thereby allowing the pump to be reassembled and put back into service.

Similarly, if a pump module fails a quality inspection (for example high operating torque) during initial assembly, then the pump module may be rejected and replaced with another pre-assembled pump module.

The pump modules will typically comprise a timing section which aligns the two opposing rotors in each pump module and typically contains timing gears and thrust bearings. The timing section may operate in the pumped fluid, or may be sealed from the rotor section by shaft seals.

If the timing section is exposed to the pumped fluid the gears and bearings are appropriately specified for operating in a dirty fluid with low lubricity. Appropriate corrosion and abrasion resistant coatings are well known to those skilled in the art as are appropriate thrust bearing designs.

An advantageous aspect of providing a separate external housing for the components of the pump is that it is then possible to provide a conduit for lubricating oil connecting all the pump module timing sections. For instance, a shallow slot or groove in the internal face of the external housing or the external face of the pump modules and spacer units may provide fluid communication, e.g. a continuous oil passage, along the length of the pump. Further, a channel containing a non return valve, from the passage to each timing section, may allow the provision of lubricating oil.

In addition, an oil reservoir in pressure communication with the pump intake may be provided to ensure that the timing sections are pressure balanced with respect to the surrounding well fluid when the pump is stationary.

When the pump operates, typically the pressure may not be uniform within the pump but may increase progressively stage by stage from the intake to the discharge of the pump. The non-return valves may prevent pressure communication between higher pressure timing sections near the discharge and lower pressure timing sections near the intake, which, were non return valves not fitted would tend to vent oil from the higher pressure timing sections to the lower pressure timing sections. For particularly high pressure pumps, timing sections that may operate in the pumped fluid may be preferred.

It will be appreciated that the present invention provides a multistage pump, preferably a multistage twin screw pump and a method of making the same, which is both simple and versatile, since individual pump modules may be quickly and reliably pre-assembled prior to being incorporated within the multistage pump. Moreover, the rotor pairs within the pre-assembled pump modules are timed both axially and rotationally. Thus, a multistage pump may be efficiently assembled incorporating a series of almost any number of pump modules. Also, it will be appreciated that no complex flow paths need to be provided between the discharge of one pump module and the intake of the next pump module in the series.

It should also be appreciated that the pre-assembled pump modules need not all be of the same pump type. For example, it may be advantageous to provide a multistage pump in which the first pump module is a twin screw pump and the or each subsequent pump module comprises a centrifugal pump. This configuration may be beneficial since the twin screw pump may compress a multiphase fluid being pumped therethrough, thereby reducing the gas fraction of said fluid. The gas fraction may be sufficiently reduced such that the fluid may be effectively pumped using one or more centrifugal pump modules. Preferably, the or each centrifugal pump module may be pre-assembled. An intermediate adapter module may be required between a twin screw pump module and a subsequent centrifugal pump module to allow the transition from a pair of shafts (in the twin screw pump module) to a single shaft (in the centrifugal pump module). Suitable designs for intermediate adapter modules will be apparent to the person skilled in the art. Further hybrid multistage pumps comprising at least one twin screw pump module and one or more pump modules of other pump types will be apparent to the person skilled in the art.

It is envisaged that the pump of the present invention may be suitable for any application where a pump is required to deliver high differential pressures to move a multiphase fluid. For instance, the pump may find particular utility in hydrocarbon production, e.g. in production wells and injection wells, and for the boosting of a multiphase (oil, water, gas) fluid stream, for example in pipeline pumping stations and subsea multiphase pumping.

The invention claimed is:

1. A multistage pump comprising:

a plurality of components comprising a plurality of pre-assembled pump modules including at least one twin screw pump module;

wherein the multistage pump further comprises an elongate sleeve for housing the components and securing means attachable or engagable with a portion of the elongate sleeve, the securing means being operable to fixedly retain the components within the sleeve, and wherein each of the pre-assembled pump modules comprises at least one thrust bearing.

2. A multistage pump as claimed in claim 1 comprising a discrete thrust bearing for each rotor of the or each twin screw pump module.

3. A multistage pump as claimed in claim 1, wherein the or each twin screw pump module comprises a pair of intermeshing rotors, one of which is shorter than the other.

4. A multistage pump as claimed in claim 1 further comprising one or more spacer units.

5. A multistage pump as claimed in claim 4, wherein the or each spacer unit is a discrete component.

6. A multistage pump as claimed in claim 1, wherein the plurality of components further comprises a drive coupling assembly.

7. A multistage pump as claimed in claim 1, wherein an inner surface of the sleeve or an outer surface of each of the components is provided with a longitudinally extending groove to provide a conduit allowing fluid communication from a source of lubricating fluid to the components within the pump.

8. A multistage pump as claimed in claim 1, in which the components are arranged in series within the sleeve.

9. A multistage pump as claimed in claim 1, in which the elongate sleeve has a wall which is discontinuous.

10. An assembly comprising a multistage pump according to claim 1 and a motor for driving the pump.

11. An assembly according to claim 10, in which the motor is located above or below the pump.

12. A method of producing a fluid from or injecting a fluid into a hydrocarbon-bearing formation comprising deploying and operating a multistage pump (4) according to claim 1 within a well.

13. A method of assembling a multistage pump comprising:

providing a plurality of components comprising a plurality of pre-assembled pump modules including at least one twin screw pump module, each of the pre-assembled pump modules comprising at least one thrust bearing;

arranging the components into a stack such that the pump modules are located in series;

inserting the stack within an outer housing or sleeve; and operating securing means to fixedly secure the stack within the outer housing or sleeve.

* * * * *